US006455215B1

(12) United States Patent
Hashimoto et al.

(10) Patent No.: US 6,455,215 B1
(45) Date of Patent: Sep. 24, 2002

(54) MAGENTA TONER FOR ELECTROPHOTOGRAPHY, MAGENTA DEVELOPER FOR ELECTROPHOTOGRAPHY, AND IMAGE FORMING METHOD USING THE SAME

(75) Inventors: Masaki Hashimoto; Masanori Ichimura; Michio Take; Hiroshi Takano, all of Minami-ashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 878 days.

(21) Appl. No.: 09/035,888

(22) Filed: Mar. 9, 1998

Related U.S. Application Data

(63) Continuation of application No. 08/769,266, filed on Dec. 18, 1996, now abandoned.

(30) Foreign Application Priority Data

Dec. 25, 1995 (JP) ..... 7-336411

(51) Int. Cl.[7] ..... G03G 9/09

(52) U.S. Cl. ..... 430/108.23; 430/107.1; 430/108.21; 430/109.4; 430/126

(58) Field of Search ..... 430/106, 126, 430/45, 108.23, 108.21, 107.1

(56) References Cited

U.S. PATENT DOCUMENTS

| | | | |
|---|---|---|---|
| 2,962,374 | A | 11/1960 | Dessauer |
| 4,533,614 | A | 8/1985 | Fukumoto et al. |
| 5,032,483 | A | 7/1991 | Ichimura et al. |
| 5,620,820 | A | 4/1997 | Bertrand et al. |

FOREIGN PATENT DOCUMENTS

| | | |
|---|---|---|
| JP | B-49-46951 | 12/1974 |
| JP | B-50-776 | 1/1975 |
| JP | 52-17023 | 8/1977 |
| JP | A-57-130043 | 8/1982 |
| JP | A-57-130044 | 8/1982 |
| JP | A-62-280778 | 12/1987 |
| JP | A-3-156469 | 7/1991 |

OTHER PUBLICATIONS

Chemical Abstracts: Pigment Red 81, 1997.

*Primary Examiner*—Christopher Rodee
(74) *Attorney, Agent, or Firm*—Oliff & Berridge, PLC

(57) ABSTRACT

An electrophotographic magenta toner which comprises a binder resin and a colorant comprising (a) 0.5 to 15 parts by weight of C.I. Pigment Red 57:1 and (b) 0.5 to 15 parts by weight of C.I. Pigment Red 81 or C.I. Pigment Red 122, per 100 parts by weight of the toner. A magenta developer comprising the magenta toner, and a full color image forming method using the magenta toner or developer are also disclosed.

20 Claims, No Drawings

MAGENTA TONER FOR ELECTROPHOTOGRAPHY, MAGENTA DEVELOPER FOR ELECTROPHOTOGRAPHY, AND IMAGE FORMING METHOD USING THE SAME

This is a Continuation of application Ser. No. 08/769,266 filed Dec. 18, 1996 abandoned. The disclosure of the prior application(s) is hereby incorporated by reference herein in its entirety.

FIELD OF THE INVENTION

The present invention relates to an electrophotographic toner, particularly a magenta toner suitable for forming a color image. This invention also relates to an electrophotographic magenta developer, and an image formation method using the magenta toner or magenta developer.

BACKGROUND OF THE INVENTION

Color development is generally based on a three color synthesis system, such as a subtractive color process, in which at least three layers of electrostatic latent images are formed, developed with at least three different color toners, and superimposed on copying paper to give a full color image as described in U.S. Pat. No. 2,962,374.

Examples of color toners comprising pigments as a colorant include those described in JP-B-49-46951 (the term "JP-B" as used herein means an "examined published Japanese patent application") and JP-A-52-17023 (the term "JP-A" as used herein means an "unexamined published Japanese patent application"). Examples of color toners comprising dyes as a colorant include those disclosed in JP-A-57-130043 and JP-A-57-130044.

Colorants which have been commonly used for a magenta toner for color electrophotography include azo lake pigments, anthraquinone dyes, quinacridone pigments, rhodamine dyes and lake pigments thereof. Of these colorants, rhodamine dyes are suitable as a colorant of a magenta toner because of their broad range of color reproducibility and high coloring power. However, they are disadvantageous for image preservation in that they are apt to migrate to a polyvinyl chloride (PVC) sheet and have poor resistance to light. Azo lake pigments are magenta pigments providing a red tone in a processed color. They have satisfactory reproducibility of a red tone in a processed color, high coloring power and excellent preservability as compared with other magenta pigments. Further, they are unwilling to adhere to a PVC sheet and have excellent light resistance. However, as compared with rhodamine dyes, azo lake pigments have a narrow range of color reproduction and are inferior in reproduction of a blue tone in a processed color. Quinacridone pigments, which are magenta pigments having a blue tone, provide satisfactory reproduction of a blue color in a processed color and also exhibit excellent preservability, and are therefore suitable as a magenta colorant. However, they have poor red color reproducibility in a processed color in nature of their color characteristics.

SUMMARY OF THE INVENTION

The present invention has been achieved to solve the above described problems of conventional colorants for magenta toner.

Therefore, an object of the present invention is to provide a magenta toner and a magenta developer for color electrophotography which have good color developability and an adequately broad range of color reproduction and are excellent in resistance against adhesion to a PVC sheet, light resistance, and image preservability, and to provide a full color image forming method using the toner or developer.

Other objects and effects of the present invention will be apparent from the following description.

The present inventors have sought for colorants for a color electrophotographic magenta toner excellent in color developability, color reproducibility, resistance to adhesion to a PVC sheet and light resistance. As a result, they have found that the above object of the invention can be achieved by incorporating (a) a compound classified as C.I. Pigment Red 57:1 and (b) a compound classified as C.I. Pigment Red 81 or C.I. Pigment Red 122 into a toner. The present invention has been completed based on this finding.

The present invention relates to an electrophotographic magenta toner which comprises a binder resin and a colorant comprising (a) 0.5 to 15 parts by weight of C.I. Pigment Red 57:1 and (b) 0.5 to 15 parts by weight of C.I. Pigment Red 81 or C.I. Pigment-Red 122, each per 100 parts by weight of the toner.

The invention also relates to an electrophotographic magenta developer comprising magnetic particles and a magenta toner, wherein said magnetic particles comprises core particles having thereon a resin coating layer, and wherein said magenta toner comprises a binder resin and a colorant comprising (a) 0.5 to 15 parts by weight of C.I. Pigment Red 57:1 and (b) 0.5 to 15 parts by weight of C.I. Pigment Red 81 or C.I. Pigment Red 122, each per 100 parts by weight of the toner.

The invention further relates to a method for forming a full color image comprising the steps of:

forming a latent image on a latent image carrier;

developing the latent image using a developer on a developer carrier to form a toner image on the latent image carrier; and transferring the toner image onto an image-receiving member;

wherein the developing step is conducted by using, as one developer, a magenta toner comprising a binder resin and a colorant comprising (a) 0.5 to 15 parts by weight of C.I. Pigment Red 57:1 and (b) 0.5 to 15 parts by weight of C.I. Pigment Red 81 or C.I. Pigment Red 122, each per 100 parts by weight of the toner.

DETAILED DESCRIPTION OF THE INVENTION

The magenta toner of the invention is characterized by containing (a) C.I. Pigment Red 57:1 and (b) C.I. Pigment Red 81 or C.I. Pigment Red 122 as colorants. The magenta toner containing C.I. Pigment Red 57:1 and C.I. Pigment Red 81 provides a magenta toner image having markedly excellent light resistance. The magenta toner containing C.I. Pigment Red 57:1 and C.I. Pigment Red 122 exhibits improved color reproducibility. Thus, the magenta toners in both embodiments provide a magenta color image having excellent characteristics. These colorants are preferably subjected to flushing-processing prior to use.

The compound classified as C.I. Pigment Red 57:1 has the following structural formula:

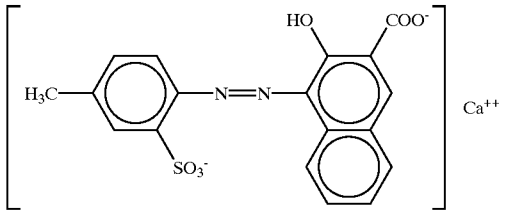

The compound classified as C.I. Pigment Red 81 has the following structural formula:

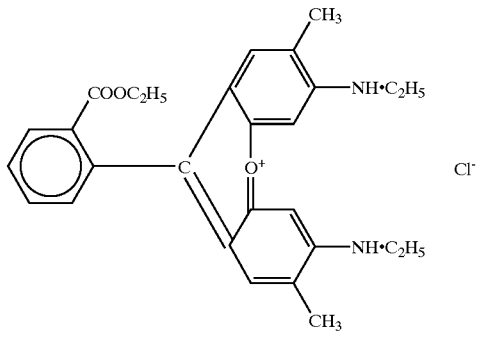

The compound classified as C.I. Pigment Red 122 has the following structural formula:

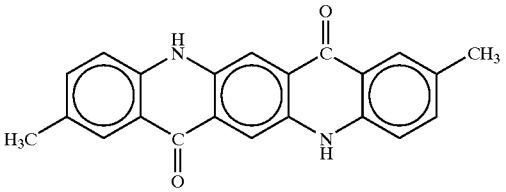

C.I. Pigment Red 57:1 is used in an amount of 0.5 to 15 parts by weight, preferably 1 to 10 parts by weight, per 100 parts by weight of the toner. If the content of this colorant is less than 0.5 part, the toner-has weak coloring power, failing to produce sufficient effects as expected. If it exceeds 15 parts, tone deviation is caused to show poor color reproduction. C.I. Pigment Red 81 is used in an amount of 0.5 to 15 parts by weight, preferably 0.5 to 10 parts by weight, still preferably 0.5 to 8 parts by weight, per 100 parts by weight of the toner. C.I. Pigment Red 122 is used in an amount of 0.5 to 15 parts by weight, preferably 1 to 10 parts by weight, still preferably 1 to 8 parts by weight, per 100 parts by weight of the toner. If the content of C.I. Pigment Red 81 or C.I. Pigment Red 122 is less than 0.5 part, the toner has weak coloring power, failing to produce sufficient effects as expected. If it exceeds 15 parts, the resistance against adhesion to a PVC sheet and the light resistance are deteriorated.

The mixing ratio of the two kinds of the colorants preferably ranges from 2:8 to 8:2. The total content of the two colorants preferably ranges from 1 to 20 parts by weight, more preferably 2 to 18 parts by weight, per 100 parts by weight of the toner. If the total content of the two colorants is less than 1 part, the toner has weak coloring power. If it exceeds 20 parts, the toner has reduced transparency and deteriorated fixing properties.

The binder resin for use in the magenta toner of the invention is required to ensure low temperature fixing properties, transparency and color developability of the resulting toner. Taking the above into consideration, polyester resins are preferably used as the binder resin. Polyester resins are produced by reacting a polyhydric alcohol and a polybasic carboxylic acid or a reactive acid derivative thereof. Suitable polyhydric alcohols constituting the polyester resin include diols, such as ethylene glycol, diethylene glycol, triethylene glycol, 1,2-propylene glycol, 1,3-propylene glycol, 1,4-butanediol, neopentylene glycol and cyclohexanedimethanol; hydrogenated bisphenol A; alkylene oxide adducts of bisphenol A such as polyoxyethylene-bisphenol A and polyoxypropylene-bisphenol A; and other dihydric alcohols. Suitable polybasic carboxylic acids include malonic acid, succinic acid, adipic acid, sebacic acid, alkylsuccinic acids, maleic acid, fumaric acid, mesaconic acid, citraconic acid, itaconic acid, glutaconic acid, cyclohexanedicarboxylic acid, isophthalic acid, terephthalic acid and other dibasic carboxylic acids; and reactive acid derivatives thereof such as anhydrides, alkyl esters and acid halides.

The polyester resins may further contain tri- or higher-hydric alcohol components and/or tri- or higher-basic carboxylic acid components so as to become non-linear as long as tetrahydrofuran insoluble matter is not produced. Examples of the trihydric or higher-hydric alcohols are sorbitol, 1,2,3,6-hexanetetraol, 1,4-sorbitan, pentaerythritol, 1,2,4-butanetriol, 1,2,5-pentanetriol, glycerol, 2-methylpropanetriol-, 2-methyl-1,2,4-butanetriol, trimethylolethane, trimethylpropane, and 1,3,5-trimethylolbenzene. Examples of the tri- or higher-basic carboxylic acids are 1,2,4-butanetricarboxylic acid, 1,2,4-cyclohexanetricarboxylic acid, 1,2,4-benzenetricarboxylic acid, 1,2,5-benzenetricarboxylic acid, and 2,5,7-naphthalenetricarboxylic acid.

Of these polyester, resins particularly preferred are polycondensates mainly comprising, as its monomer units, an aromatic polycarboxylic acid component and a bisphenol A component (e.g., a linear polyester obtained from terephthalic acid, an ethylene-oxide adduct of bisphenol A and cyclohexanedimethanol). The linear polyester has a softening point of, preferably, from 90 to 150° C., a glass transition point of, preferably, from 50 to 70° C., a number average molecular weight of, preferably, from 2000 to 6000, a weight average molecular weight of, preferably, from 8000 to 150000, an acid value of, preferably, from 5 to 30, and a hydroxyl value of, preferably, from 25 to 45.

The volume average particle diameter of the toner particles for use in the present invention is generally from 3 to 15 $\mu$m, preferably from 5 to 10 $\mu$m.

Charging properties of the toner may be controlled by the binder resin or the colorants themselves. If desired, a charge control agent which gives no adverse influence on color reproduction may be added. For example, metal chelates such as premetallized dyes, and acidic or electron-attracting organic substances can be used as a negative charge control agent; and quaternary ammonium salts or other basic electron-donating organic substances can be used as a positive charge control agent. In using the positive charge control agent, the terminal carboxyl groups of the polyester resin are preferably pretreated prior to use. The charge control agent can be mixed with the binder resin or be adhered to the surface of the toner particles. In order to remove the influence of the colorants on toner charging properties, the charge control agent may be added in the pretreatment of the colorants. In addition to the-charge control agent, the electrical properties of the toner can be controlled by addition of a solid electrolyte, a polymer electrolyte, a charge transfer complex, a metal oxide (e.g., tin oxide, silica, alumina or titanium oxide), a ferroelectric substance, a magnetic substance and the like. If desired, the toner may contain an extender pigment, a reinforcing filler such as a fibrous material, a thermal characteristic conditioning agent, a dynamic characteristic conditioning agent, an antiseptic, an antioxidant, a deodorizer, a foaming agent, a parting agent, a tackifier and the like. The content of the above described additives (e.g., a charge control agent) is generally from 0.01 to 20% by weight, preferably from 0.1 to 10% by weight, based on the total weight of the toner.

Further, various external additives may be externally adhered or fixed to the surface of the toner particles for improving powder fluidity or charging properties of the toner, preventing the toner from filming on the surface of a photoreceptor or carrier particles, and for improving cleanability of a residual toner on a photoreceptor. Examples of the external additives include fine particles of stearic acid or an ester, amide or metal salt thereof, tin oxide, fluorinated graphite, silicon carbide, boron nitride, silica, aluminum oxide, titanium dioxide, or zinc oxide, and a fluorine resin, an acrylic resin, a polycyclic aromatic compound, a waxy substance, and crosslinked or non-crosslinked resin powder. These external additives may be added in an amount of from 0.01 to 10 parts by weight, preferably from 0.1 to 5 parts by weight, per 100 parts by weight of the toner.

The magenta toner of the invention can be used either as a one-component developer or a two-component developer as combined with a magnetic carrier. The carrier for use in the two-component developer includes iron powder, glass beads, ferrite powder, magnetite powder, a magnetic carrier of dispersed system in a resin which is prepared by kneading a magnetic material, a charge control agent, etc. and a resin followed by grinding and classifying the mixture, and a resin-coated magnetic carrier prepared by coating the surface of the above described carrier-particles with a resin. The magnetic carrier having a resin coat is particularly preferred for maintenance of charging properties.

The core particles of the resin-coated carrier particles can be iron powder, glass beads, ferrite powder, nickel powder or magnetite powder. The resin-coated carrier preferably has a volume resistivity of $10^6$ to $10^9$ Ωcm.

The resin for use in the resin-coated magnetic particles preferably includes acrylic resins, fluororesins, and silicone resins. In particular, silicone resin- or fluoroacrylate resin-coated carriers are preferred.

Examples of monomers constituting the fluoroacrylate resins include an acrylic or methadrylic ester of 1,1-dihydroperfluoroethyl, 1,1-dihydroperfluoropropyl, 1,1-dihydroperfluorohexyl, 1,1-dihydroperfluorooctyl, 1,1-dihydroperfluorodecyl, 1,1-dihydroperfluorolauryl, 1,1,2,2-tetrahydroperfluorobutyl, 1,1,2,2-tetrahydroperfluorohexyl, 1,1,2,2-tetrahydroperfluorooctyl, 1,1,2,2-tetrahydroperfluorodecyl, 1,1,2,2-tetrahydroperfluorolauryl, 1,1,2,2-tetrahydroperfluorostearyl, 2,2,3,3-tetrafluoropropyl, 2,2,3,3,4,4-hexafluorobutyl, 1,1,ω-trihydroperfluorohexyl, 1,1,-ω-trihydroperfluorooctyl, 1,1,1,3,3,3-hexafluoro-2-propyl, 3-perfluorononyl-2-acetylpropyl, 3-perfluorolauryl-2-acetylpropyl, N-perfluorohexylsulfonyl-N-methylaminoethyl, N-perfluorohexylsulfonyl-N-butylaminoethyl, N-perfluorooctylsulfonyl-N-ethylaminoethyl, N-perfluorooctylsulfonyl-N-butylaminoethyl, N-perfluorodecylsulfonyl-N-methylaminoethyl, N-perfluorodecylsulfonyl-N-ethylaminoethyl, N-perfluorolaurylsulfonyl-N-methylaminoethyl, N-perfluorodecylsulfonyl-N-butylaminoethyl or N-perfluorolaurylsulfonyl-N-butylaminoethyl.

Suitable monomers copolymerizable with the above-described perfluoroacrylate monomers include styrene, alkylstyrenes (e.g., methylstylene, dimethylstyrene, trimethylstyrene, ethylstyrene, diethylstyrene, triethylstyrene, propylstyrene, butylstyrene, hexylstyrene, heptylstyrene and octylstyrene), halogenated styrenes (e.g., fluorostyrene, chlorostyrene, bromostyrene, dibromostyrene, and iodostyrene) and other styrene monomers (e.g., nitrostyrene, acetylstyrene and methoxystyrene); addition polymerizable unsaturated aliphatic monocarboxylic acids (e.g., acrylic acid, methacrylic acid, α-ethylacrylic acid, crotonic acid, α-methylcrotonic acid, β-ethylcrotonic acid, isocrotonic acid, tiglic acid and angelic acid); addition polymerizable unsaturated aliphatic dicarboxylic acids (e.g., maleic acid, fumaric acid, itaconic acid, citraconic acid, mesaconic acid, glutaconic acid and dihydromuconic acid); and esters of these addition polymerizable unsaturated aliphatic mono- or dicarboxylic acids and an alcohol such as an alkyl alcohol (e.g., methanol, ethanol, propanol, butanol, amyl alcohol, hexyl alcohol, heptyl alcohol, octyl alcohol, nonyl alcohol, dodecyl alcohol, tetradecyl alcohol or hexadecyl alcohol), an alkoxyalkyl alcohol prepared by alkoxylating the above described alcohol (e.g., methoxyethyl alcohol, ethoxyethyl alcohol, ethoxyethoxyethyl alcohol, methoxypropyl alcohol or ethoxypropyl alcohol), an aralkyl alcohol (e.g., benzyl alcohol, phenylethyl alcohol or phenylpropyl alcohol) or an alkenyl alcohol (e.g., allyl alcohol or crotonyl alcohol). Preferred of them are alkyl acrylates, alkyl methacrylates, alkyl fumarates and alkyl maleates.

When the developer of the present invention is a two-component developer, generally from 0.1 to 30 parts by weight, preferably from 0.1 to 20 parts by weight, of the toner is mixed with 100 parts by weight of the carrier.

The full color image formation method according to the invention comprises the steps of forming a latent image on a latent image carrier, developing the latent image with a developer on a developer carrier to form a toner image on the latent image carrier, transferring the toner image onto an image receiving member. Any known technique for full color image formation can be applied to the image forming method of the present invention. For example, an electrostatic latent image is formed on an electrophotographic photoreceptor or a dielectric recording material in a known manner, and the resulting latent image is repeatedly developed to form a magenta toner image, a yellow toner image and a cyan toner image, and these toner images are transferred to an image-receiving member followed by fixing to provide a full color image. The electrophotographic photoreceptor may be a selenium-based photoreceptor, an organic photoreceptor or an amorphous silicon photoreceptor.

The present invention will be described in greater detail with reference to the following Examples, but the invention should not be construed as being limited thereto. Unless otherwise indicated, all the parts are by weight.

EXAMPLE 1

Preparation of Pellets 1:

| | |
|---|---|
| Linear polyester resin (obtained from terephthalic acid, an ethylene oxide adduct of bisphenol A, and cyclohexanedimethanol; glass transition point: 64° C.; number average molecular weight: 4500; weight average molecular weight: 10000; acid value: 23) | 70 parts |
| C.I. Pigment Red 57:1 | 30 parts |

A mixture of the above components was melted at 150° C. in a kneading machine and mixed while cooling. The mixture was passed through a two-roll mill and pelletized to obtain pellets 1.

Preparation of Pellets 2:

Pellets 2 were prepared in the same manner as for pellets 1, except for replacing C.I. Pigment Red 57:1 with C.I. Pigment Red 81.

Preparation of Pellets 3:

Pellets 3 were prepared in the same manner as for pellets 1, except for replacing C.I. Pigment Red 57:1 with C.I. Pigment Yellow 17.

Preparation of Pellets 4:

Pellets 4 were prepared in the same manner as for pellets 1, except for replacing C.I. Pigment Red 57:1 with C.I. Pigment Blue 15:3.

Preparation of Magenta Toner:

| | |
|---|---|
| Linear polyester resin-(the same as those used in the pellets) | 66.7 parts |
| Pellets 1 | 26.7 parts |
| Pellets 2 | 6.6 parts |

The above components were mixed well in a kneading machine, crushed in a cutter mill, pulverized in a pulverizer using an air jet, and air-classified to obtain particles having an average particle size of 7 $\mu$m. To 100 parts of thus obtained particles was added 0.8 part of titanium oxide fine particles in a Henschel mixer to prepare a magenta toner.

Preparation of Cyan Toner:

A cyan toner was prepared from 16.7 parts of the same linear polyester resin as used in the pellets and 83.3 parts of pellets 3 in the same manner as for the magenta toner.

Preparation of Yellow Toner:

A yellow toner was prepared from 16.7 parts of the same linear polyester resin as used in the pellets and 83.3 parts of pellets 4 in the same manner as for the magenta toner.

Preparation of Carrier:

Spherical particles of iron having an average particle size of 50 $\mu$m were coated with a fluorine-containing acrylic resin (a perfluorooctylethyl methacrylate-methyl methacrylate copolymer (30:70); weight average molecular weight: 38000) in a kneader coater to prepare a carrier having a resin coat of about 1.0 $\mu$m in thickness.

Preparation of Developer:

A magenta developer was prepared by mixing 5 parts of the magenta toner and 100 parts of the carrier.

A cyan developer was prepared by mixing 5 parts of the cyan toner and 100 parts of the carrier.

A yellow developer was prepared by mixing 5 parts of the yellow toner and 100 parts of the carrier.

EXAMPLE 2

| | |
|---|---|
| Linear polyester resin, (the same as that used in the pellets) | 66.7 parts |
| Pellets 1 | 20 parts |
| Pellets 2 | 13.3 parts |

A magenta toner was prepared from the above components in the same manner as in Example 1.

A magenta developer was prepared by mixing 5 parts of the magenta toner and 100 parts of the same carrier as that used in Example 1.

A cyan developer and a yellow developer were prepared in the same manner as in Example 1.

EXAMPLE 3

| | |
|---|---|
| Linear polyester resin (the same as that used in the pellets) | 66.7 parts |
| Pellets 1 | 13.3 parts |
| Pellets 2 | 20 parts |

A magenta toner was prepared from the above components in the same manner as in Example 1.

A magenta developer was prepared by mixing 5 parts of the magenta toner and 100 parts of the same carrier as that used in Example 1.

A cyan developer and a yellow developer were prepared in the same manner as in Example 1.

EXAMPLE 4

| | |
|---|---|
| Linear polyester resin, (the same as that used in the pellets) | 83.3 parts |
| Pellets 1 | 13.3 parts |
| Pellets 2 | 3.4 parts |

A magenta toner was prepared from the above components in the same manner as in Example 1.

A magenta developer was prepared by mixing 5 parts of the magenta toner and 100 parts of the same carrier as that used in Example 1.

A cyan developer and a yellow developer were prepared in the same manner as in Example 1.

EXAMPLE 5

| | |
|---|---|
| Linear polyester resin (the same as that used in the pellets) | 83.3 parts |
| Pellets 1 | 16.7 parts |
| Pellets 2 | 10 parts |

A magenta toner was prepared from the above components in the same manner as in Example 1.

A magenta developer was prepared by mixing 5 parts of the magenta toner and 100 parts of the same carrier as that used in Example 1.

A cyan developer and a yellow developer were prepared in the same manner as in Example 1.

EXAMPLE 6

| | |
|---|---|
| Linear polyester resin (the same as that used in the pellets) | 83.3 parts |
| Pellets 1 | 10 parts |
| Pellets 2 | 16.7 parts |

A magenta toner was prepared from the above components in the same manner as in Example 1.

A magenta developer was prepares by mixing 5 parts of the magenta toner and 100 parts of the same carrier as that used in Example 1.

A cyan developer and a yellow developer were prepared in the same manner as in Example 1.

EXAMPLE 7

| | |
|---|---|
| Linear polyester resin (the same as that used in the pellets) | 43.3 parts |
| Pellets 1 | 50 parts |
| Pellets 2 | 6.7 parts |

A magenta toner was prepared from the above components in the same manner as in Example 1.

A magenta developer was prepared by mixing 5 parts of the magenta toner and 100 parts of the same carrier as that used in Example 1.

A cyan developer and a yellow developer were prepared in the same manner as in Example 1.

EXAMPLE 8

| | |
|---|---|
| Linear polyester resin (the same as used in the pellets) | 50 parts |
| Pellets 1 | 33.3 parts |
| Pellets 2 | 16.7 parts |

A magenta toner was prepared from the above components in the same manner as in Example 1.

A magenta developer was prepared by mixing 5 parts of the magenta toner and 100 parts of the same carrier as that used in Example 1.

A cyan developer and a yellow developer were prepared in the same manner as in Example 1.

EXAMPLE 9

| | |
|---|---|
| Linear polyester resin (the same as that used in the pellets) | 90 parts |

-continued

| | |
|---|---|
| Pellets 1 | 8.3 parts |
| Pellets 2 | 1.7 parts |

A magenta toner was prepared from the above components in the same manner as in Example 1.

A magenta developer was prepared by mixing 5 parts of the magenta toner and 100 parts of the same carrier as that used in Example 1.

A cyan developer and a yellow developer were prepared in the same manner as in Example 1.

EXAMPLE 10

| | |
|---|---|
| Linear polyester resin (the same as used in the pellets) | 90 parts |
| Pellets 1 | 6.7 parts |
| Pellets 2 | 3.3 parts |

A magenta toner was prepared from the above components in the same manner as in Example 1.

A magenta developer was prepared by mixing 5 parts of the magenta toner and 100 parts of the same carrier as that used in Example 1.

A cyan developer and a yellow developer were prepared in the same manner as in Example 1.

COMPARATIVE EXAMPLE 1

| | |
|---|---|
| Pellets 1 | 66.7 parts |
| Pellets 2 | 33.3 parts |

A magenta toner was prepared from the above components in the same manner as in Example 1.

A magenta developer was prepared by mixing 5 parts of the magenta toner and 100 parts of the same carrier as that used in Example 1.

A cyan developer and a yellow developer were prepared in the same manner as in Example 1.

COMPARATIVE EXAMPLE 2

| | |
|---|---|
| Linear polyester resin (the same as that used in the pellets) | 66.7 parts |
| Pellets 1 | 33.3 parts |

A magenta toner was prepared from the above components in the same manner as in Example 1.

A magenta developer was prepared by mixing 5 parts of the magenta toner and 100 parts of the same carrier as that used in Example 1.

A cyan developer and a yellow developer were prepared in the same manner as in Example 1.

COMPARATIVE EXAMPLE 3

| | |
|---|---|
| Linear polyester resin (the same as that used in the pellets) | 83.3 parts |
| Pellets 2 | 16.7 parts |

A magenta toner was prepared from the above components in the same manner as in Example 1.

A magenta developer was prepared by mixing 5 parts of the magenta toner and 100 parts of the same carrier as that used in Example 1.

A cyan developer and a yellow developer were prepared in the same manner as in Example 1.

COMPARATIVE EXAMPLE 4

| | |
|---|---|
| Linear polyester resin (the same as that used in the pellets) | 50 parts |
| Pellets 1 | 49.3 parts |
| Pellets 2 | 0.7 part |

A magenta toner was prepared from the above components in the same manner as in Example 1.

A magenta developer was prepared by mixing 5 parts of the magenta toner and 100 parts of the same carrier as that used in Example 1.

A cyan developer and a-yellow developer were prepared in the same manner as in Example 1.

COMPARATIVE EXAMPLE 5

| | |
|---|---|
| Linear polyester resin (the same as that used in the pellets) | 98.3 parts |
| Pellets 1 | 0.7 parts |
| Pellets 2 | 1 parts |

A magenta toner was prepared from the above components in the same manner as in Example 1.

A magenta developer was prepared by mixing 5 parts of the magenta toner and 100 parts of the same carrier as that used in Example 1.

A cyan developer and a yellow developer were prepared in the same manner as in Example 1.

COMPARATIVE EXAMPLE 6

| | |
|---|---|
| Linear polyester resin (the same as that used in the pellets) | 20 parts |
| Pellets 1 | 20 parts |
| Pellets 2 | 60 parts |

A magenta toner was prepared from the above components in the same manner as in Example 1.

A magenta developer was prepared by mixing 5 parts of the magenta toner and 100 parts of the same carrier as that used in Example 1.

A cyan developer and a yellow developer were prepared in the same manner as in Example 1.

Evaluation

Copies were taken of an original having patches of seven colors: magenta, yellow, cyan, red, green, blue and black, on a copying machine A-Color 935 manufactured by Fuji Xerox Co., Ltd. using the three color developers prepared in Examples 1 to 10 and comparative Examples 1 to 5. The resulting color copies were evaluated as follows. The results of evaluation are shown in Table 1 below.

1) Color Reproducibility

The magenta, red and blue colors on the copy were calorimetrically analyzed with X-Rite 968 and graded as follows.

A . . . Reproduction of the three colors was good.

B . . . Reproduction of one of the three colors was poor.

C . . . Reproduction of two or all of the three colors was poor.

2) Light Resistance

The copy was irradiated for 60 hours in a fadeometer. The level of color deviation in magenta, red and blue colors due to irradiation was graded as follows.

A . . . $\Delta E$ of each color was less than 3.

B . . . $\Delta E$ of one of the three colors was 3 or more.

C . . . $\Delta$ of two or all of the three colors was 3 or more.

3) Antiadhesion to PVC Sheet

A PVC sheet was put on-the image side of the copy and allowed to stand at 50° C. and 50% RH for 24 hours with a load of 10 g/cm$^2$ applied thereon. Migration of the colorants to the PVC sheet was observed with the naked eye and graded as follows.

G1 . . . No migration of the colorants to the sheet was observed.

G2 . . . Some migration of the colorants to the sheet was observed in parts.

G3 . . . Slight migration of the colorants was observed all over the sheet.

G4 . . . Considerable migration of the colorants was observed all over the sheet.

4) Transparency

Copies were taken on OHP sheets, and the transparency of the transferred image was observed with the naked eye and graded as follows.

A . . . Good.

B . . . Poor in parts.

C . . . Poor all over the copy.

5) Fixing Properties

The color patch area of the copy was folded using a weight having a given load, and the toner image at the fold was observed in terms of image defect and graded as follows.

G1 . . . No fall-off of the toner was observed.

G2 . . . A slight line of fold was observed but with no fall-off of the toner.

G3 . . . Appreciable cracks and fall-off of the toner were observed at the fold.

G4 . . . Fall-off of the toner occurred not only at the fold but at other parts.

6) Total Judgement

A . . . Excellent

B . . . Usable

C . . . Impractical

TABLE 1

| | Magenta Toner | | | | | | | |
|---|---|---|---|---|---|---|---|---|
| | C.I. Pigment Red 57:1 (wt %) | C.I. Pigment Red 81 (wt %) | Color Reproducibility | Light Resistance | Anti-adhesion to PVC Sheet | Transparency | Fixing Properties | Total Judgement |
| Example No. | | | | | | | | |
| 1 | 8 | 2 | A | A | G1 | A | G1 | A |
| 2 | 6 | 4 | A | A | G1 | A | G1 | A |
| 3 | 4 | 6 | A | A | G2 | A | G1 | A |
| 4 | 4 | 1 | A | A | G1 | A | G1 | A |
| 5 | 4.5 | 2.7 | A | A | G1 | A | G1 | A |
| 6 | 2.7 | 4.5 | A | A | G2 | A | G1 | A |
| 7 | 15 | 2 | B | A | G1 | A | G1 | A |
| 8 | 10 | 5 | A | A | G2 | A | G1 | A |
| 9 | 2.5 | 0.5 | A | A | G1 | A | G1 | A |
| 10 | 2 | 1 | A | A | G1 | A | G1 | A |
| Comparative Example: | | | | | | | | |
| 1 | 20 | 10 | A | B | G3 | B | G3 | B |
| 2 | 10 | 0 | B | A | G1 | B | G1 | B |
| 3 | 0 | 5 | B | C | G4 | A | G1 | C |
| 4 | 14.8 | 0.2 | C | A | G1 | B | G2 | C |
| 5 | 0.2 | 0.3 | C | C | G1 | A | G1 | C |
| 6 | 6 | 18 | B | C | G4 | B | G2 | C |

EXAMPLE 11

Preparation of Pellets 5:

Pellets 5 were prepared in the same manner as for pellets 1 except for replacing C.I. Pigment Red 57:1 with C.I. Pigment Red 122.

Preparation of Magenta Toner:

| | |
|---|---|
| Linear polyester resin (the same as that used in the pellets) | 86.7 parts |
| Pellets 1 | 10 parts |
| Pellets 5 | 3.3 parts |

A magenta toner was prepared from the above components in the same manner as in Example 1.

Preparation of Developer:

A magenta developer was prepared by mixing 5 parts of the magenta toner and 100 parts of the same carrier as that used in Example 1.

A cyan developer and a yellow developer were prepared in the same manner as in Example 1.

EXAMPLE 12

| | |
|---|---|
| Linear polyester resin (the same as that used in the pellets) | 86.6 parts |
| Pellets 1 | 6.7 parts |
| Pellets 5 | 6.7 parts |

A magenta toner was prepared from the above components in the same manner as in Example 1.

A magenta developer was prepared by mixing 5 parts of the magenta toner and 100 parts of the same carrier as that used in Example 1.

A cyan developer and a yellow developer were prepared in the same manner as in Example 1.

EXAMPLE 13

| | |
|---|---|
| Linear polyester resin (the same as that used in the pellets) | 66.7 parts |
| Pellets 1 | 26.7 parts |
| Pellets 5 | 6.7 parts |

A magenta toner was prepared from the above components in the same manner as in Example 1.

A magenta developer was prepared by mixing 5 parts of the magenta toner and 100 parts of the same carrier as that used in Example 1.

A cyan developer and a yellow developer were prepared in the same manner as in Example 1.

EXAMPLE 14

| | |
|---|---|
| Linear polyester resin (the same as that used in the pellets) | 36.7 parts |
| Pellets 1 | 13.3 parts |
| Pellets 5 | 50 parts |

A magenta toner was prepared from the above components in the same manner as in Example 1.

A magenta developer was prepared by mixing 5 parts of the magenta toner and 100 parts of the same carrier as that used in Example 1.

A cyan developer and a yellow developer were prepared in the same manner as in Example 1.

EXAMPLE 15

| | |
|---|---|
| Linear polyester resin (the same as that used in the pellets) | 33.3 parts |
| Pellets 1 | 50 parts |
| Pellets 5 | 16.7 parts |

A magenta toner was prepared from the above components in the same manner as in Example 1.

A magenta developer was prepared by mixing 5 parts of the magenta toner and 100 parts of the same carrier as that used in Example 1.

A cyan developer and a yellow developer were prepared in the same manner as in Example 1.

EXAMPLE 16

| | |
|---|---|
| Linear polyester resin (the same as that used in the pellets) | 58.3 parts |
| Pellets 1 | 40 parts |
| Pellets 5 | 1.7 parts |

A magenta toner was prepared from the above components in the same manner as in Example 1.

A magenta developer was prepared by mixing 5 parts of the magenta toner and 100 parts of the same carrier as that used in Example 1.

A cyan developer and a yellow developer were prepared in the same manner as in Example 1.

EXAMPLE 17

| | |
|---|---|
| Linear polyester resin (the same as that used in the pellets) | 71.7 parts |
| Pellets 1 | 1.7 parts |
| Pellets 5 | 26.6 parts |

A magenta toner was prepared from the above components in the same manner as in Example 1.

A magenta developer was prepared by mixing 5 parts of the magenta toner and 100 parts of the same carrier as that used in Example 1.

A cyan developer and a yellow developer were prepared in the same manner as in Example 1.

COMPARATIVE EXAMPLE 7

| | |
|---|---|
| Linear polyester resin (the same as that used in the pellets) | 66.7 parts |
| Pellets 1 | 33.3 parts |

A magenta toner was prepared from the above components in the same manner as in Example 1.

A magenta developer was prepared by mixing 5 parts of the magenta toner and 100 parts of the same carrier as that used in Example 1.

A cyan developer and a yellow developer were prepared in the same manner as in Example 1.

COMPARATIVE EXAMPLE 8

| | |
|---|---|
| Linear polyester resin (the same as that used in the pellets) | 16.7 parts |
| Pellets 1 | 66.7 parts |
| Pellets 5 | 16.7 parts |

A magenta toner was prepared from the above components in the same manner as in Example 1.

A magenta developer was prepared by mixing 5 parts of the magenta toner and 100 parts of the same carrier as that used in Example 1.

A cyan developer and a yellow developer were prepared in the same manner as in Example 1.

COMPARATIVE EXAMPLE 9

| | |
|---|---|
| Pellets 1 | 66.7 parts |
| Pellets 5 | 33.3 parts |

A magenta toner was prepared from the above components in the same manner as in Example 1.

A magenta developer was prepared by mixing 5 parts of the magenta toner and 100 parts of the same carrier as that used in Example 1.

A cyan developer and a yellow developer were prepared in the same manner as in Example 1.

COMPARATIVE EXAMPLE 10

| | |
|---|---|
| Linear polyester resin (the same as that used in the pellets) | 73.3 parts |
| Pellets 5 | 26.7 parts |

A magenta toner was prepared from the above components in the same manner as in Example 1.

A magenta developer was prepared by mixing 5 parts of the magenta toner and 100 parts of the same carrier as that used in Example 1.

A cyan developer and a yellow developer were prepared in the same manner as in Example 1.

COMPARATIVE EXAMPLE 11

| | |
|---|---|
| Linear polyester resin (the same as that used in the pellets) | 98.3 parts |
| Pellets 1 | 1 part |
| Pellets 5 | 0.7 part |

A magenta toner was prepared from the above components in the same manner as in Example 1.

A magenta developer was prepared by mixing 5 parts of the magenta toner and 100 parts of the same carrier as that used in Example 1.

A cyan developer and a yellow developer were prepared in the same manner as in Example 1.

COMPARATIVE EXAMPLE 12

| | |
|---|---|
| Linear polyester resin (the same as that used in the pellets) | 26.7 parts |
| Pellets 1 | 13.3 parts |
| Pellets 5 | 60 parts |

A magenta toner was prepared from the above components in the same manner as in Example 1.

A magenta developer was prepared by mixing 5 parts of the magenta toner and 100 parts of the same carrier as that used in Example 1.

A cyan developer and a yellow developer were prepared in the same manner as in Example 1.

Evaluation

Copies were taken of an original having patches of seven colors, magenta, yellow, cyan, red, green, blue and black on a copying machine A-Color 935 manufactured by Fuji Xerox Co., Ltd. using the three color developers prepared in Examples 11 to 16 and comparative Examples 6 to 10. The resulting color copies were evaluated in the same manner as the evaluation for the developers of Example 1. The results of evaluation are shown in Table 2 below.

TABLE 2

| | Magenta Toner | | | | | | |
|---|---|---|---|---|---|---|---|
| | C.I. Pigment Red 57:1 (wt %) | C.I. Pigment Red 122 (wt %) | Color Reproducibility | Anti-adhesion to PVC Sheet | Transparency | Fixing Properties | Total Judgement |
| Example No. | | | | | | | |
| 11 | 3 | 1 | A | G1 | A | G1 | A |
| 12 | 2 | 2 | A | G1 | A | G1 | A |
| 13 | 8 | 2 | A | G1 | A | G1 | A |
| 14 | 4 | 15 | A | G1 | A | G1 | A |
| 15 | 15 | 5 | A | G1 | A | G1 | A |
| 16 | 12 | 0.5 | A | G1 | A | G1 | |
| 17 | 0.5 | 8 | A | G1 | A | G1 | A |
| Comparative Example: | | | | | | | |
| 7 | 10 | 0 | B | G1 | B | G1 | B |
| 8 | 20 | 5 | A | G2 | B | G2 | B |
| 9 | 20 | 10 | A | G3 | C | G3 | C |
| 10 | 0 | 8 | C | G1 | A | G1 | C |
| 11 | 0.3 | 0.2 | C | G1 | A | G1 | C |
| 12 | 4 | 18 | C | G2 | B | G2 | C |

According to the present invention, the combined use of (a) C.I. Pigment Red 57:1 and (b) C.I. Pigment Red 81 or C.I. Pigment Red 122 as a colorant of a magenta toner produces excellent effects such that the resulting magenta toner or magenta developer have (1) good color reproducibility, (2) excellent resistance to light and to adhesion to a PVC sheet, and thus stable fixing properties. The full color image forming method according to the invention provides a full color image excellent in color reproduction, light resistance and transparency.

While the invention has been described in detail and with reference to specific examples thereof, it will be apparent to one skilled in the art that various changes and modifications can be made therein without departing from the spirit and scope thereof.

What is claimed is:

1. An electrophotographic magenta toner which comprises a binder resin and a colorant comprising (a) 0.5 to 15 parts by weight of C.I. Pigment Red 57:1 and (b) 0.5 to 15 parts by weight of C.I. Pigment Red 122, per 100 parts by weight of said toner.

2. The magenta toner as claimed in claim 1, wherein said colorants (a) and (b) are flushing-pigments.

3. The magenta toner as claimed in claim 1, wherein the total content of colorants (a) and (b) is from 1 to 20 parts by weight per 100 parts by weight of said toner.

4. The magenta toner as claimed in claim 1, wherein said binder resin comprises a polyester resin.

5. The magenta toner as claimed in claim 4, wherein said polyester resin is a linear polyester.

6. The magenta toner as claimed in claim 4, wherein said polyester resin has a softening point of from 90 to 150° C.

7. The magenta toner as claimed in claim 4, wherein said polyester resin has a glass transition point of from 50 to 70° C.

8. The magenta toner as claimed in claim 1, wherein the ratio of C.I. Pigment Red 57:1 to C.I. Pigment Red 122 is from 2:8 to 8:2.

9. An electrophotographic magenta developer comprising magnetic particles and a magenta toner, said magnetic particles comprising core particles having thereon a resin coating layer, and said magenta toner comprising a binder resin and a colorant comprising (a) 0.5 to 15 parts by weight of C.I. Pigment Red 57:1 and (b) 0.5 to 15 parts by weight of C.I. Pigment 122, per 100 parts by weight of said toner.

10. The magenta developer as claimed in claim 9, wherein said colorants (a) and (b) are flushing-pigments.

11. The magenta developer as claimed in claim 9, wherein the total content of colorants (a) and (b) is from 1 to 20 parts by weight per 100 parts by weight of said toner.

12. The magenta developer as claimed in claim 9, wherein said resin coating layer of the magnetic particles comprises a resin selected from the group consisting of silicone resins, acrylic resins and fluororesins.

13. The magenta developer as claimed in claim 9, wherein said binder resin comprises a polyester resin.

14. The magenta developer as claimed in claim 13, wherein said polyester resin is a linear polyester.

15. The magenta developer as claimed in claim 13, wherein said polyester resin has a softening point of from 90 to 150° C.

16. The magenta developer as claimed in claim 13, wherein said polyester resin has a glass transition point of from 50 to 70° C.

17. A method for forming a full color image comprising the steps of:

forming a latent image on a latent image carrier;

developing the latent image using a developer on a developer carrier to form a toner image on the latent image carrier; and transferring the toner image onto an image-receiving member;

wherein said developing step is conducted by using, as one developer, a magenta toner which comprises a binder resin and a colorant comprising (a) 0.5 to 15 parts by weight of C.I. Pigment Red 57:1 and (b) 0.5 to 15 parts by weight of C.I. Pigment Red 122, per 100 parts by weight of said toner.

18. The image forming method of claim 17, wherein said colorants (a) and (b) are flushing-pigments.

19. The image forming method of claim 17, wherein the total content of colorants (a) and (b) is from 1 to 20 parts by weight per 100 parts by weight of said toner.

20. The image forming method of claim 17, wherein said binder resin comprises a polyester resin.

* * * * *